US011090221B1

(12) United States Patent
Haddock DiCarlo et al.

(10) Patent No.: US 11,090,221 B1
(45) Date of Patent: Aug. 17, 2021

(54) MASSAGER

(71) Applicant: Uccellini LLC, Bend, OR (US)

(72) Inventors: Lora LeeAnne Haddock DiCarlo, Bend, OR (US); Blake Michael Larkin, Eugene, OR (US); Ada-Rhodes Short, Corvallis, OR (US); Avery Dawn Smith, Albany, OR (US); Mazie Houchens, Corvallis, OR (US); Kim Porter Henneman, Bend, OR (US)

(73) Assignee: Uccellini LLC, Bend, OR (US)

( * ) Notice: Subject to any disclaimer, the term of this patent is extended or adjusted under 35 U.S.C. 154(b) by 0 days.

(21) Appl. No.: 16/934,292

(22) Filed: Jul. 21, 2020

(51) Int. Cl.
*A61H 19/00* (2006.01)
*A61H 23/02* (2006.01)
*A61H 23/00* (2006.01)

(52) U.S. Cl.
CPC ..... *A61H 19/34* (2013.01); *A61H 23/0254* (2013.01); *A61H 23/006* (2013.01); *A61H 2201/1418* (2013.01); *A61H 2201/169* (2013.01); *A61H 2201/1671* (2013.01); *A61H 2201/5007* (2013.01)

(58) Field of Classification Search
None
See application file for complete search history.

(56) References Cited

U.S. PATENT DOCUMENTS

2014/0309565 A1* 10/2014 Allen ..... A61H 23/04 601/46
2014/0336452 A1* 11/2014 Shahoian ..... A61H 23/0263 600/38

OTHER PUBLICATIONS amazon.com, "Partner Couple Vibrator for Clitoral & G-Spot Stimulation with 7 Pulsating & Vibration Patterns, Wireless Remote Control Rechargeable Adult Sex Toys for Women Solo Play(Nina-Vibe)", https://www.amazon.com/Stimulation-Pulsating-Vibration-Rechargeable-Nina-Vibe/dp/B083W5BQ9B/ref=sr_1_1?dchild=1&qid=1602005576&refinements=p_89%3ATracy%27s%2BDog&s=hpc&sr=1-1&th=1, Jan. 15, 2020, 6 pages.
amazon.com, "7X P-Thump Tapping Prostate Stimulator", https://www.amazon.com/7X-P-Thump-Tapping-Prostate-Stimulator/dp/B08B429D97, Jun. 12, 2020, 3 pages.
Torrens, Eugenio, "IOBA Toys Launches World's First Tapping, Silent G-Spot Massager", https://storerotica.com/ioba-toys-launches-worlds-first-tapping-silent-g-spot-massager/, Jan. 30, 2020, 3 pgs.

* cited by examiner

*Primary Examiner* — Christine H Matthews
(74) *Attorney, Agent, or Firm* — Maxine Lynn Barasch; Keohane & D'Alessandro, PLLC

(57) ABSTRACT

Disclosed embodiments provide a massager for massage and stimulation. The massager in accordance with disclosed embodiments can operate in a massage mode, or a vibration mode. The massage mode is a low-speed mode of operation. The vibration mode is a high-speed mode of operation. In some embodiments, the massager may alternate between a massage mode and a vibration mode. In this way, the massager of disclosed embodiments can perform a motion that more closely mimics human finger motion while in the massage mode, and can create a sensation of a traditional vibrator in the vibration mode. In some embodiments, the massager may alternate between a massage mode and a vibration mode to create an enhanced user experience.

15 Claims, 20 Drawing Sheets

MASSAGER

FIELD

Disclosed embodiments relate to a personal massager.

BACKGROUND

Stimulation of skin or body has many beneficial effects, including raising blood flow in the area, and stimulating nerve endings. Massage is a process of moving skin and tissue in such a way to stimulate blood flow, loosen muscles, and provide other beneficial effects. In addition, on a human body, there can be organs including a clitoris, mons pubis, labia majora, and labia minora surrounding the vagina. The glans clitoris is a portion of the clitoris that is on the vulva, external to the vagina. The glans clitoris has thousands of nerve endings, and the vulva is sexually responsive. Stimulation of a person's glans clitoris increases blood flow to the area and provides sexual pleasure. There exists a need for improvements in personal massagers that can provide increased massage or stimulation.

SUMMARY

In one embodiment, there is provided a massager, comprising: an enclosure having an opening therein; a motor disposed within the enclosure; a mechanical finger mechanically coupled to the motor, such that as the motor operates, the mechanical finger periodically protrudes from the opening of the enclosure; and a membrane disposed over at least a portion of the enclosure and covering the mechanical finger.

In another embodiment, there is provided a massager comprising: an enclosure having an opening therein; a motor disposed within the enclosure; a mechanical finger mechanically coupled to the motor, aligned with the opening; a membrane disposed over at least a portion of the enclosure and covering the mechanical finger; a processor; and a memory, wherein the memory contains instructions, that when executed by the processor, cause the mechanical finger to periodically protrude from the opening of the enclosure.

In yet another embodiment, there is provided a massager, comprising: an enclosure having an opening therein; a drive unit comprising a motor disposed within the enclosure; a mechanical finger mechanically coupled to the drive unit; wherein the mechanical finger has a first side and a second side; wherein the first side is disposed facing an interior of the enclosure; wherein the second side is disposed facing an exterior of the enclosure; wherein there is no covering over the second side of the mechanical finger; wherein the drive unit is configured to cause the mechanical finger to periodically protrude from the opening of the enclosure.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

6B is a diagram showing details of the motor controller.

Figure 7:
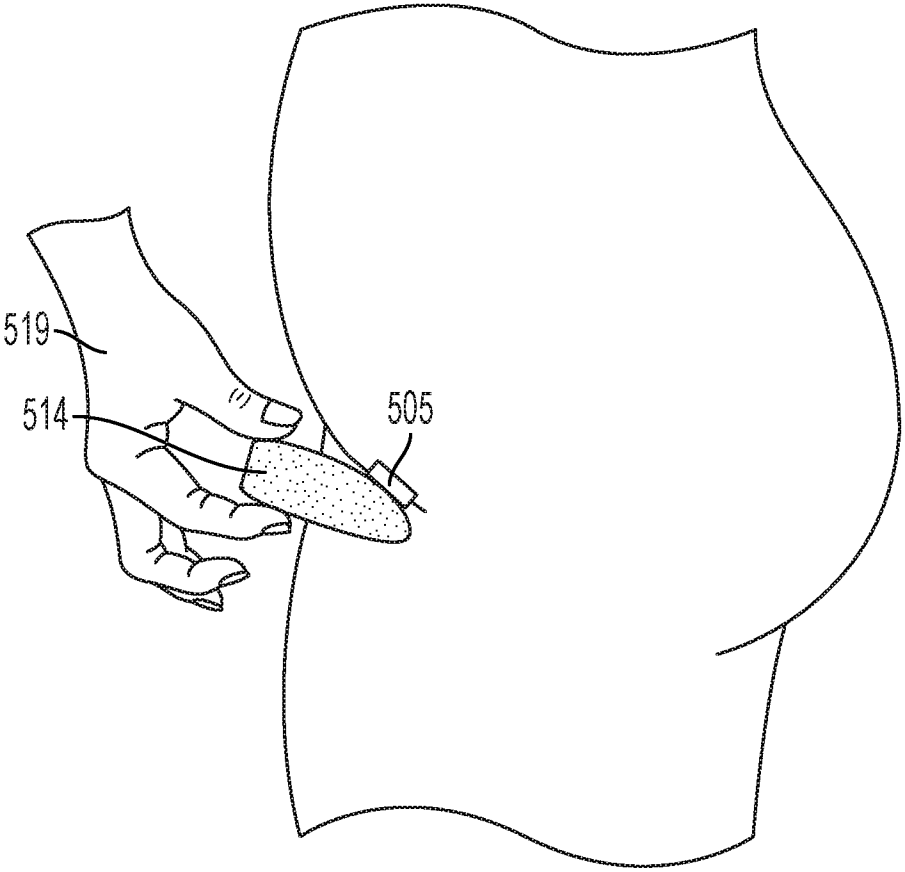

FIG. 7 shows an example usage of disclosed embodiments.

Figure 8:
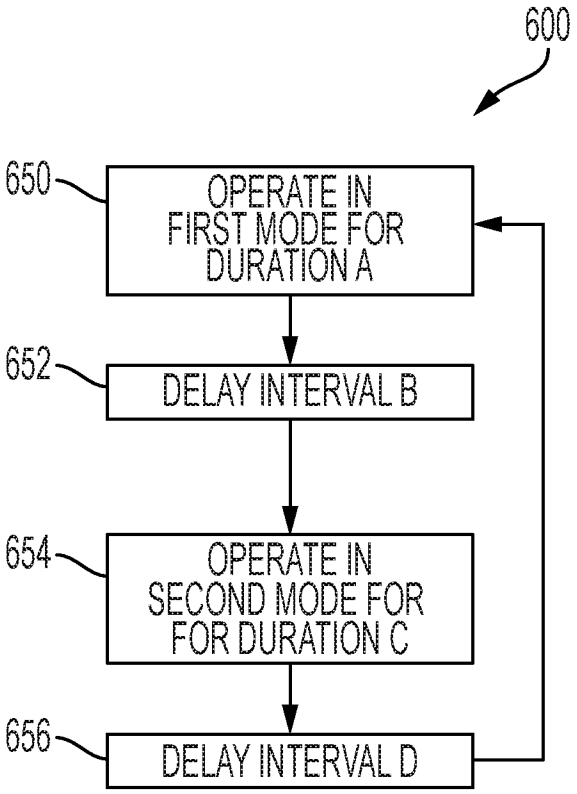

FIG. 8 is a flowchart for disclosed embodiments.

Figure 9:
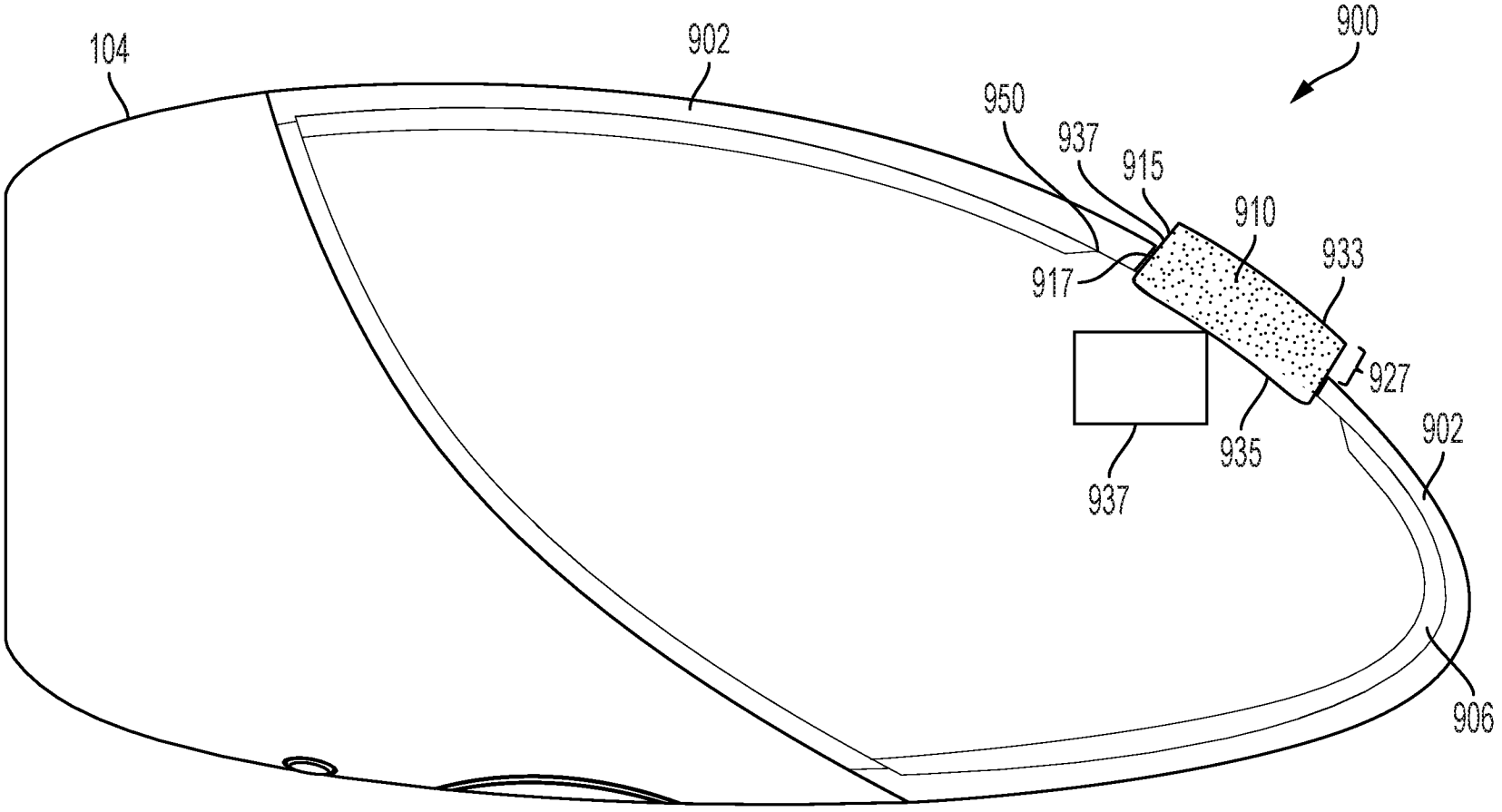

FIG. 9 shows a massager in accordance with additional embodiments.

Figure 10:
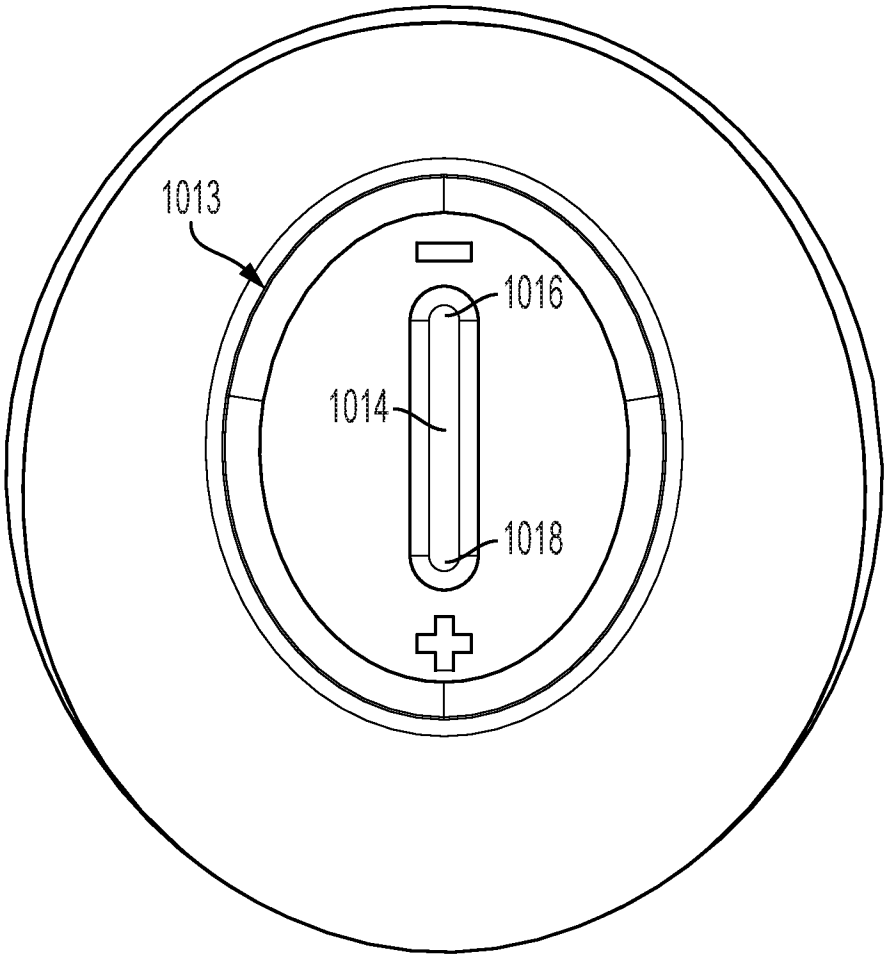

FIG. 10 shows a user interface in accordance with additional embodiments.

Figure 11:
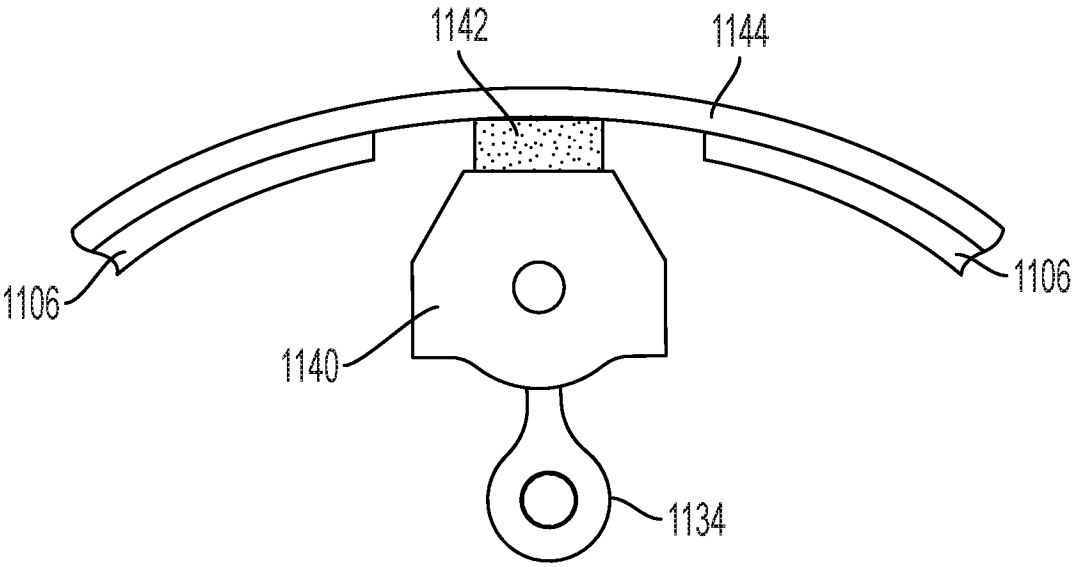

FIG. 11 shows details of a mechanical finger in accordance with additional embodiments.

DETAILED DESCRIPTION

Disclosed embodiments provide an improved massager. The massager in accordance with some embodiments can operate in a massage mode, or a vibration mode. Some embodiments may be well-suited for clitoral stimulation. On a human body, there may be organs including a clitoris, mons pubis, labia majora, and labia minora surrounding the vagina. The glans clitoris is a portion of the clitoris that is on the vulva, external to the vagina. The glans clitoris has thousands of nerve endings, and the vulva is sexually responsive. Stimulation of a person's glans clitoris increases blood flow to the area and provides sexual pleasure. In some embodiments, the massager is a sex toy or sexual aid.

The massage mode is a low-speed mode of operation. In some embodiments, the low-speed mode of operation ranges from 1 Hz to 10 Hz, or in some specific embodiments, from 2 Hz to 8 Hz or from 4 Hz to 10 Hz. The vibration mode is a high-speed mode of operation. In some embodiments, the high-speed mode of operation ranges from 15 Hz to 60 Hz. In some embodiments, the massager may alternate between a massage mode and a vibration mode. In this way, the massager of disclosed embodiments can perform a motion that more closely mimics human finger motion while in the massage mode, and can create a sensation of a traditional vibrator in the vibration mode. Appropriate speed ranges from the examples, or other suitable ranges, can be selected or programmed such that the massager achieves that result. In some embodiments, the massager may alternate between a massage mode and a vibration mode to create an enhanced user experience.

Reference throughout this specification to "one embodiment," "an embodiment," "some embodiments", or similar language means that a particular feature, structure, or characteristic described in connection with the embodiment is included in at least one embodiment of the present invention. Thus, appearances of the phrases "in one embodiment," "in an embodiment," "in some embodiments", and similar language throughout this specification may, but do not necessarily, all refer to the same embodiment.

Moreover, the described features, structures, or characteristics of the invention may be combined ("mixed and matched") in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, and/or elements. For the purposes of disclosure, the word, "substantially" is defined as "for the most part". It means "to a great extent," but having some room for some minor variation.

Figure 1A:
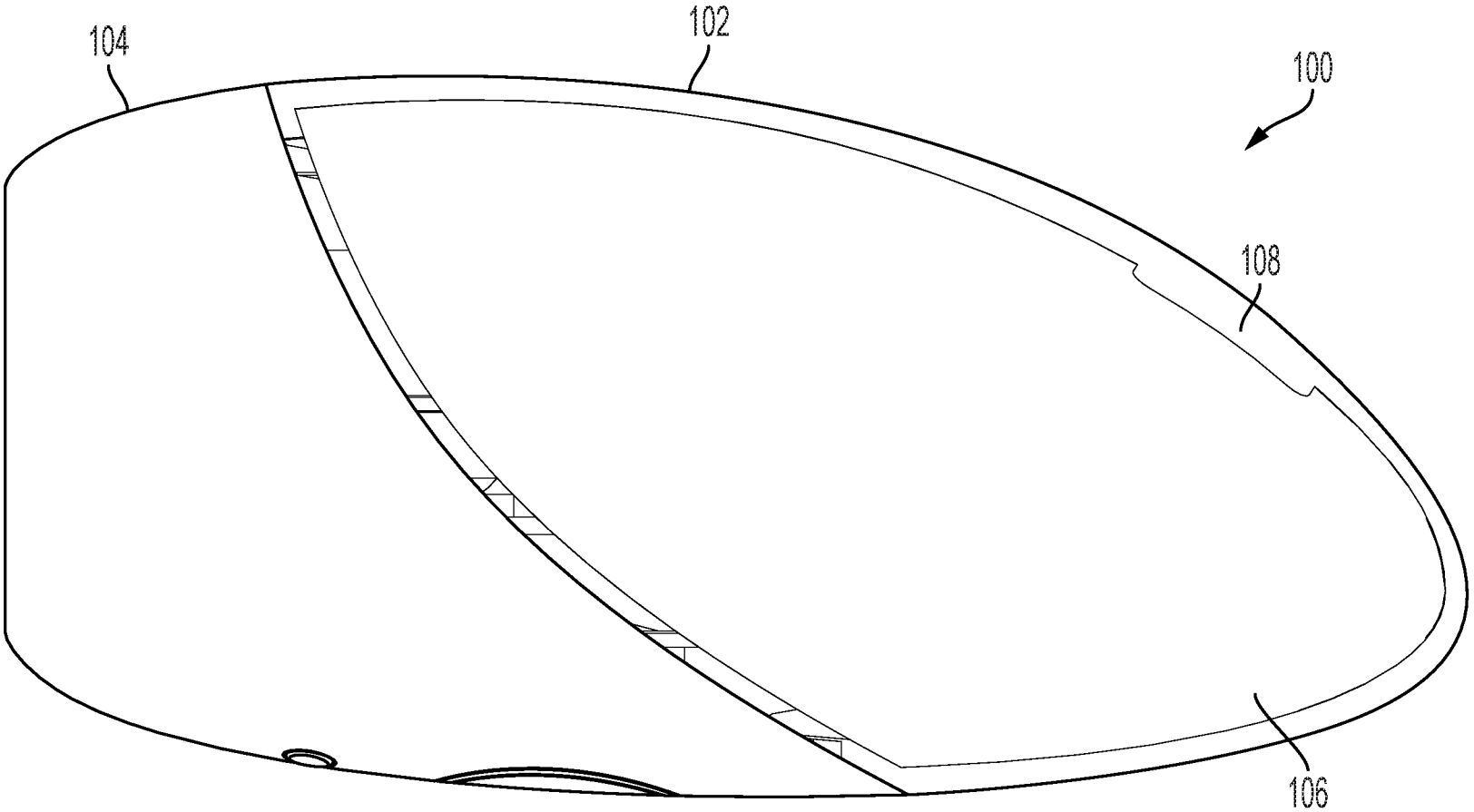
FIG. 1A shows a side view of a massager in accordance with disclosed embodiments.

FIG. 1A-1D show views of a massager in accordance with disclosed embodiments. Referring now to FIG. 1A, a side view of a massager 100 in accordance with disclosed embodiments is shown. Massager 100 comprises a rear enclosure 104, coupled to a front enclosure 106. Note that although shown as two-pieces, the enclosure ("housing") can be made of any suitable number of pieces. Note that "rear" and "front" are used herein for purposes of disclosure, and not meant to be limiting. Front enclosure 106 comprises an opening 108 to enable traversal of a mechanical finger that is used to impart stimulation to a user. In embodiments, a membrane 102 is disposed over the opening 108, over the front enclosure 106, over the full enclosure including front enclosure 106 and rear enclosure 104, or over other suitable amount of the device such that the opening 108 is covered. The entire membrane 102 may be elastic, or at least the portion surrounding opening 108. "Elastic" herein means it expands due to pressure/force, and retracts when the pressure/force is removed. In some embodiments, the membrane 102 is comprised of silicone. In some embodiments, the membrane 102 is comprised of rubber, TPE, plastic, or other suitable material.

Figure 1B:
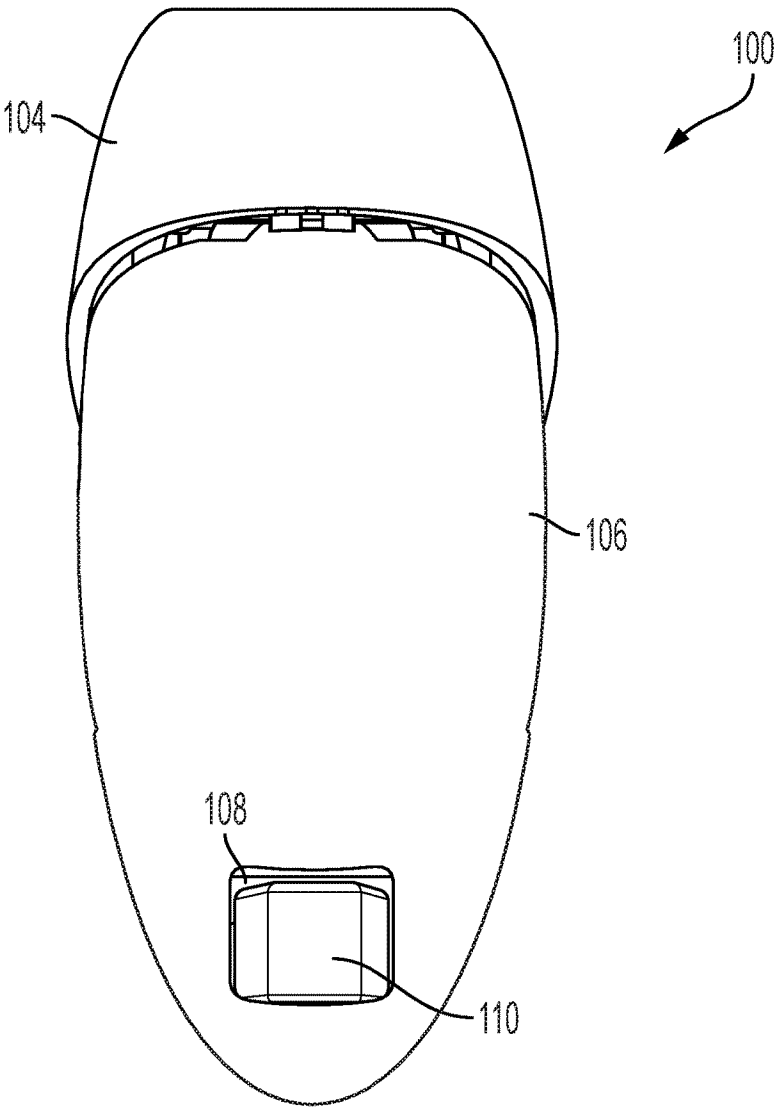
FIG. 1B shows a top-down view of a massager in accordance with disclosed embodiments.

FIG. 1B shows a view of the top of the massager of FIG. 1A with the membrane removed for clarity. In this view, mechanical finger 110 can be seen, configured and disposed to traverse front enclosure opening 108 of front enclosure 106. In operation, the mechanical finger 110 protrudes out of the enclosure periodically as the mechanical finger traverses the opening 108.

Figure 1C:
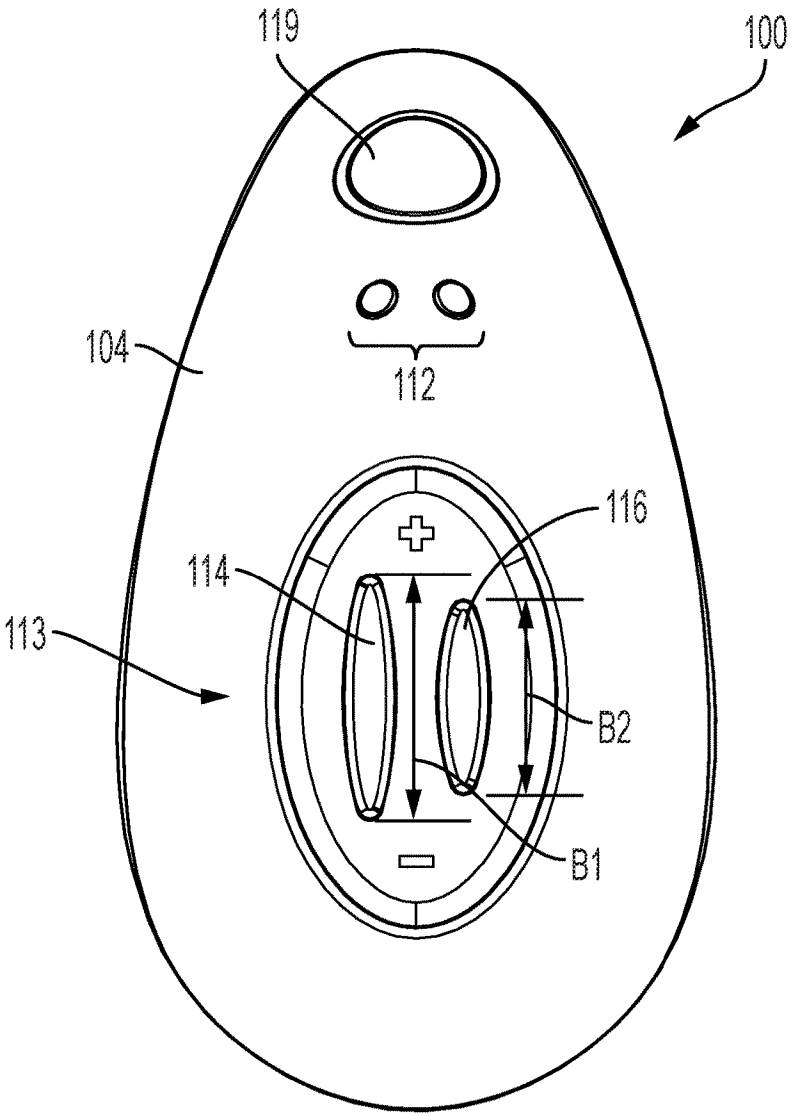
FIG. 1C shows a bottom-up view of a massager in accordance with disclosed embodiments.

FIG. 1C shows a bottom-up view of the massager of FIG. 1A. In this view, an exemplary user interface 113 is shown. In the example, it includes a speed increase control 114 and a speed decrease control 116. In embodiments, the speed increase control 114 comprises a button of a first size, and the speed decrease control 116 comprises a button of a second size, where the first size is different from the second size. In this way, a user can operate the controls of the user interface using tactile sense. In some embodiments, the buttons 114 and 116 are elongated, where button 114 has length B1, and button 116 has length B2. In embodiments, B1 is greater than B2. In some embodiments, B1 is 10 percent to 25 percent greater than B2. In some embodiments, the device is powered on or off by pressing and holding button 116 for a predetermined duration (e.g., five seconds). In other words, the user can operate the massager user interface 113 "by feel" rather than needing to have visual sight of the user interface 113. This user interface is an example, and any suitable user interface can be substituted within the scope of embodiments of the present invention. FIG. 10 shows an alternative user interface for disclosed embodiments.

In FIG. 1C, a charging port 112 is shown. In some embodiments, the charging port 112 may be an inductive charging port to enable wireless charging. In some embodiments, the charging port 112 may include a physical connection, such as a USB-C connection, or other suitable connection for charging of an internal battery. In some embodiments, the charging port 112 may include a physical connection, such as a prong receptacle. In some embodiments, the device is powered on or off by pressing and holding button 119 for a predetermined duration (e.g., five seconds).

Figure 1D:
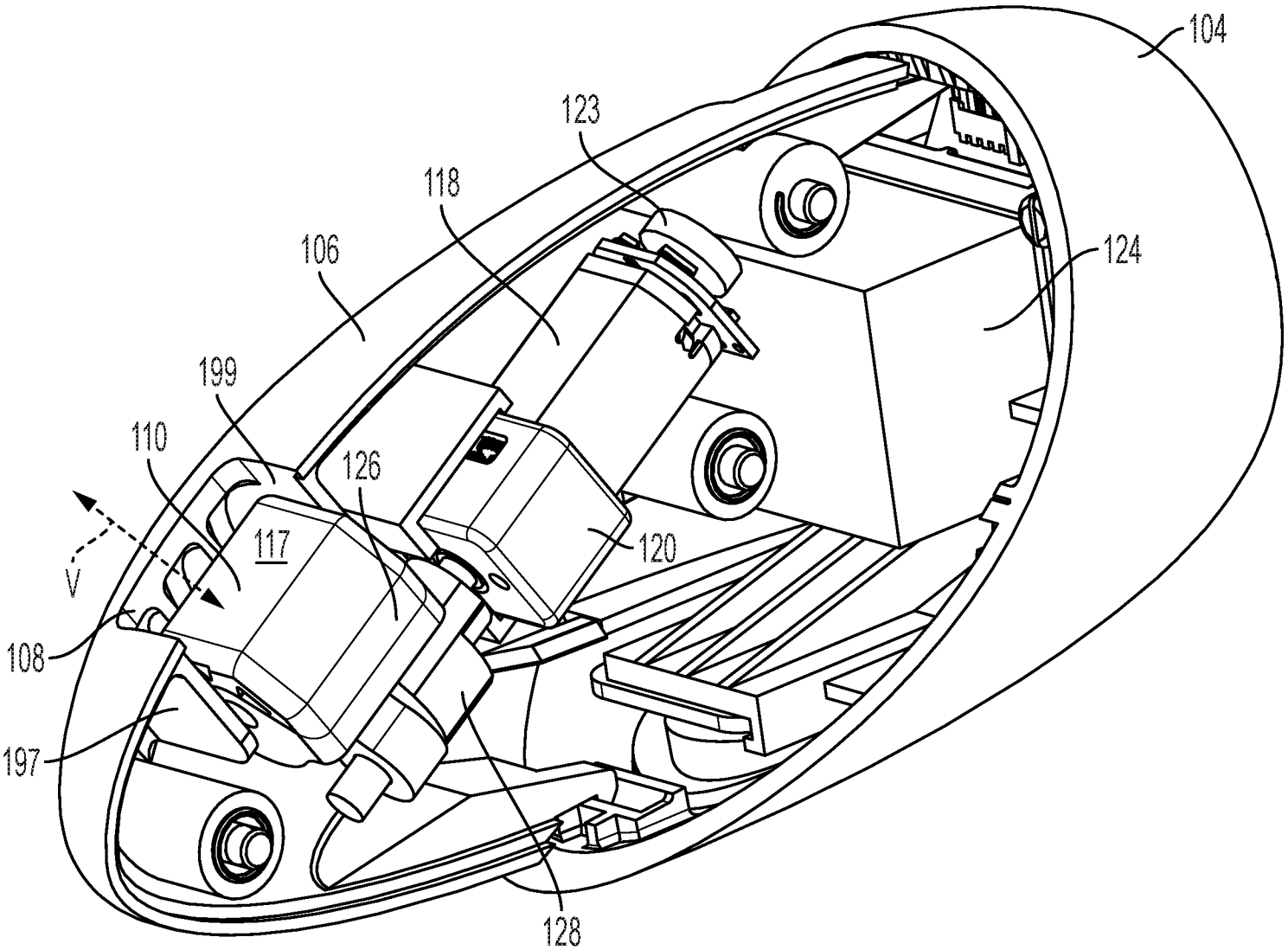
FIG. 1D shows a perspective cutaway view of a massager in accordance with disclosed embodiments.

FIG. 1D is a perspective cutaway view of the massager of FIG. 1A. In this view, various internal components of the massager 100, including but not limited to the drive unit, can be seen. For the purposes of this disclosure, the term "drive unit" refers to the motor 118, cam 128, transfer case 120, and any intervening linkages, couplings, and/or other actuation mechanisms that cause movement of the mechanical finger 110. In some embodiments, the drive unit 109 may further include an encoder 123, enabling more precise control of the shaft position. Battery 124 provides power to motor 118. In embodiments, battery 124 is a rechargeable battery. The motor 118 is mechanically coupled to the cam 128. As the cam 128 rotates, it causes mechanical finger 110 to move in a reciprocating motion such that at particular points within a rotational cycle, the mechanical finger 110 traverses the opening 108 such that the mechanical finger protrudes beyond an external boundary of front enclosure 106, enabling the imparting of a physical sensation to a user. In some embodiments, the massage surface 117 of the mechanical finger 110 is flat, or substantially flat, making it ideal for massaging sensitive parts of the body, such as the clitoris. In some embodiments, the mechanical finger 110 is approximately the same width as a typical adult human finger.

In the view of FIG. 1D, front guide 197 and rear guide 199 can be seen. The front guide 197 and rear guide 199 are disposed within the interior of front enclosure 106, proximal to opening 108. The front guide 197 and rear guide 199 serve to provide stability for the mechanical finger 110 during operation by confining the mechanical finger 110 to motion in the direction indicated by arrow V.

Figure 2A:
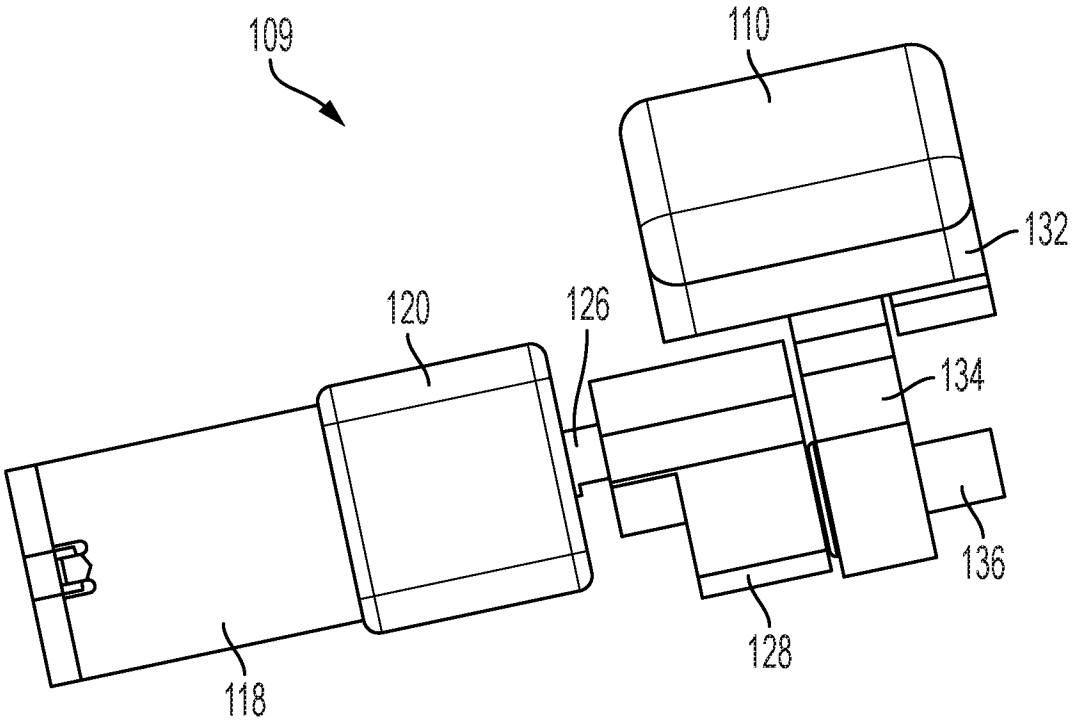
FIG. 2A shows a side view of a drive unit in accordance with some embodiments of the invention.
Figure 2B:
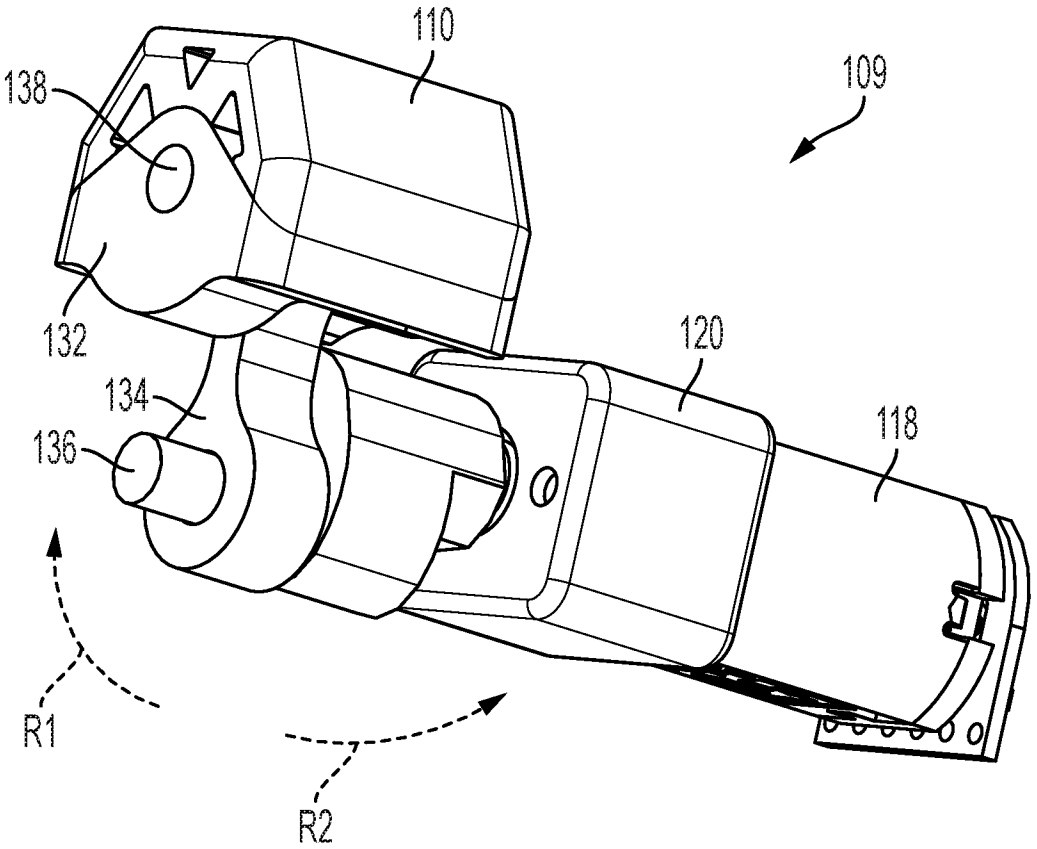
FIG. 2B is a perspective view of a drive unit in accordance with some embodiments of the invention.

FIG. 2A and FIG. 2B show details of a drive unit 109 in accordance with disclosed embodiments. FIG. 2A is a side view of drive unit 109. FIG. 2B is a perspective view of drive unit 109. Referring now in more detail to FIG. 2A and FIG. 2B, the drive unit 109 includes a motor 118 that provides rotational motion for a shaft 126. In embodiments, motor 118 may comprise a direct current (DC) electric motor. In some embodiments, optionally, a transfer case 120 may provide mechanical coupling between motor 118 and shaft 126. In some embodiments, the transfer case 120 may include multiple gears to alter the speed and/or torque of the output of the motor 118. In some embodiments, the encoder may be located outside of the transfer case 120, such as within the motor 118, or coupled to the shaft 126. A cam 128 is affixed to the shaft 126. A coupler 134 is rotatably secured to the cam 128 by second pin 136. At the opposite end of the coupler 134, a finger bracket 132 is attached to the coupler by first pin 138. As the cam 128 rotates clockwise as indicated by arrow R1, and/or counterclockwise as indicated by arrow R2, it causes the coupler 134 to move in a manner such that the mechanical finger 110 operates with a reciprocating motion to create a massage sensation for a user. In embodiments, the cam is mechanically coupled to the motor. The cam may rotate in a clockwise direction, a counterclockwise direction, or alternate therebetween, as referenced by the arrow R.

Figure 3B:
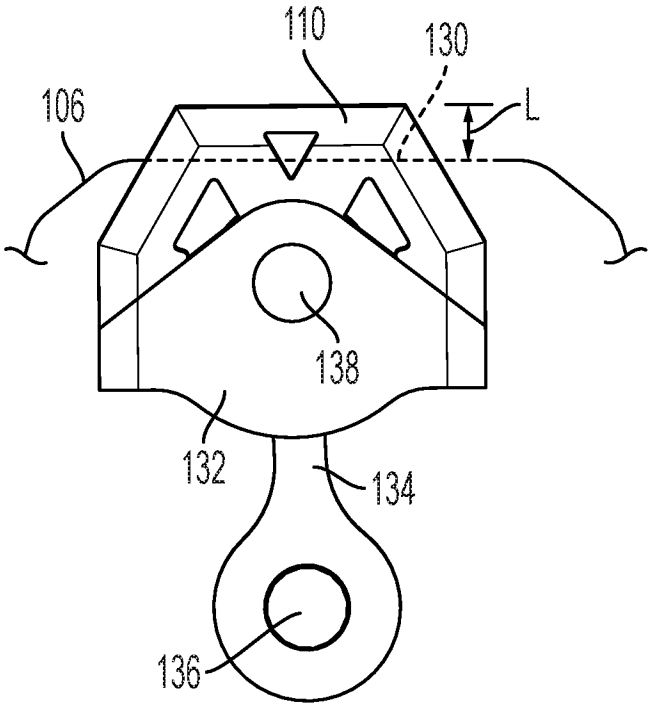
FIG. 3B shows a mechanical finger in accordance with disclosed embodiments in a raised configuration.
Figure 3A:
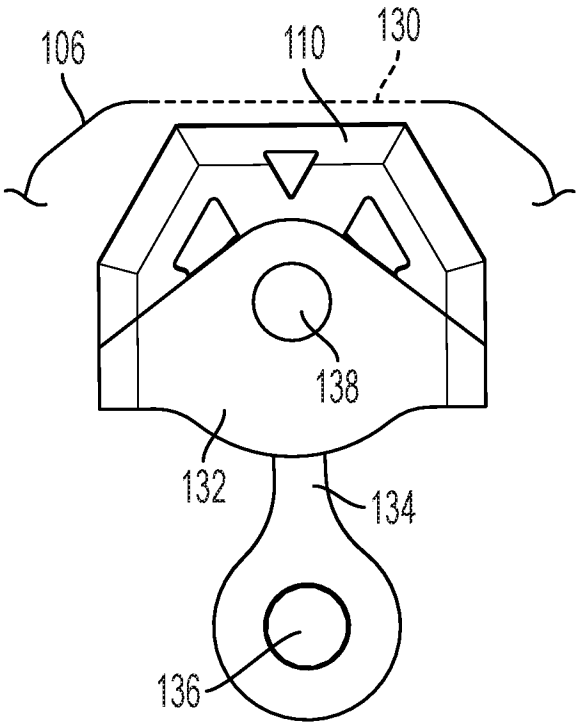
FIG. 3A shows a mechanical finger in accordance with disclosed embodiments in a lowered configuration.

FIG. 3A and FIG. 3B show details of operation of a massager in accordance with disclosed embodiments. Referring now to FIG. 3A, the mechanical finger 110 is shown, affixed to finger bracket 132. Coupler 134 is rotatably coupled to finger bracket 132 by first pin 138. Second pin 136 rotatably couples the coupler 134 to the cam 128. Referring to FIG. 3A, the mechanical finger 110 is disposed below the external boundary 130 of front enclosure 106. As the cam 128 rotates, it causes the mechanical finger 110 to raise above the external boundary 130 of front enclosure 106 by a distance L. In some embodiments, the distance L can range from 3 millimeters to 15 millimeters. In some embodiments, the distance L can range from 6 millimeters to 11 millimeters. In some embodiments, the mechanical finger 110 does not retreat below the external boundary 130 of front enclosure 106 during operation.

Referring again to FIG. 2A, part 128 rotates about shaft 126. The distance between the center of shaft 126 and the center of post 136 puts mass of the rotating parts off center from the motor shaft. Even though all the parts do not rotate around the shaft the annular momentum of part 128 combined with the linear momentum of parts 110, 132 and 134 is enough to cause a vibration. The device starts spinning at low speed where the rotation does not cause a perceptible vibration. As the speed increases the user can perceive the vibration. That transition starts around 8 hz and for most users, and the vibration is clearly perceived at 15 Hz. Below 8 Hz is "massage mode" where the mechanical finger feels more like a person's finger than a vibration.

Figure 4B:
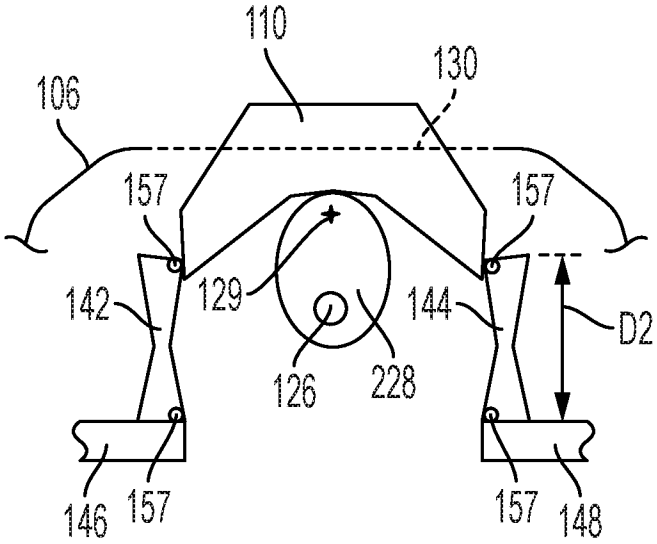
FIG. 4B shows a front view of a mechanical finger in accordance with additional disclosed embodiments in a raised configuration.
Figure 4A:
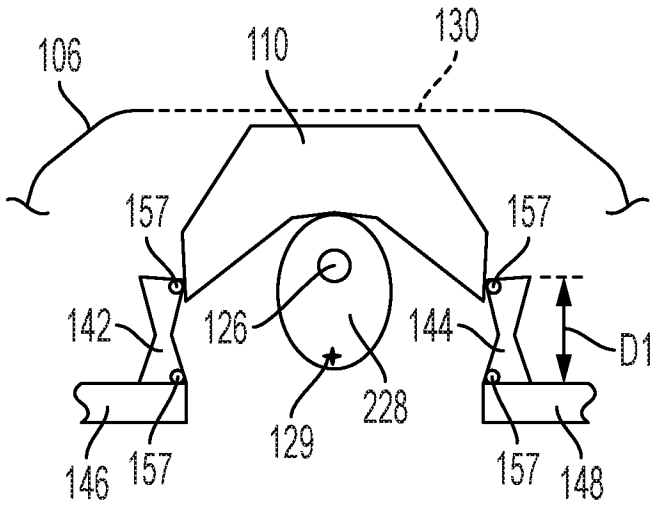
FIG. 4A shows a front view of a mechanical finger in accordance with additional disclosed embodiments in a lowered configuration.
Figure 4C:
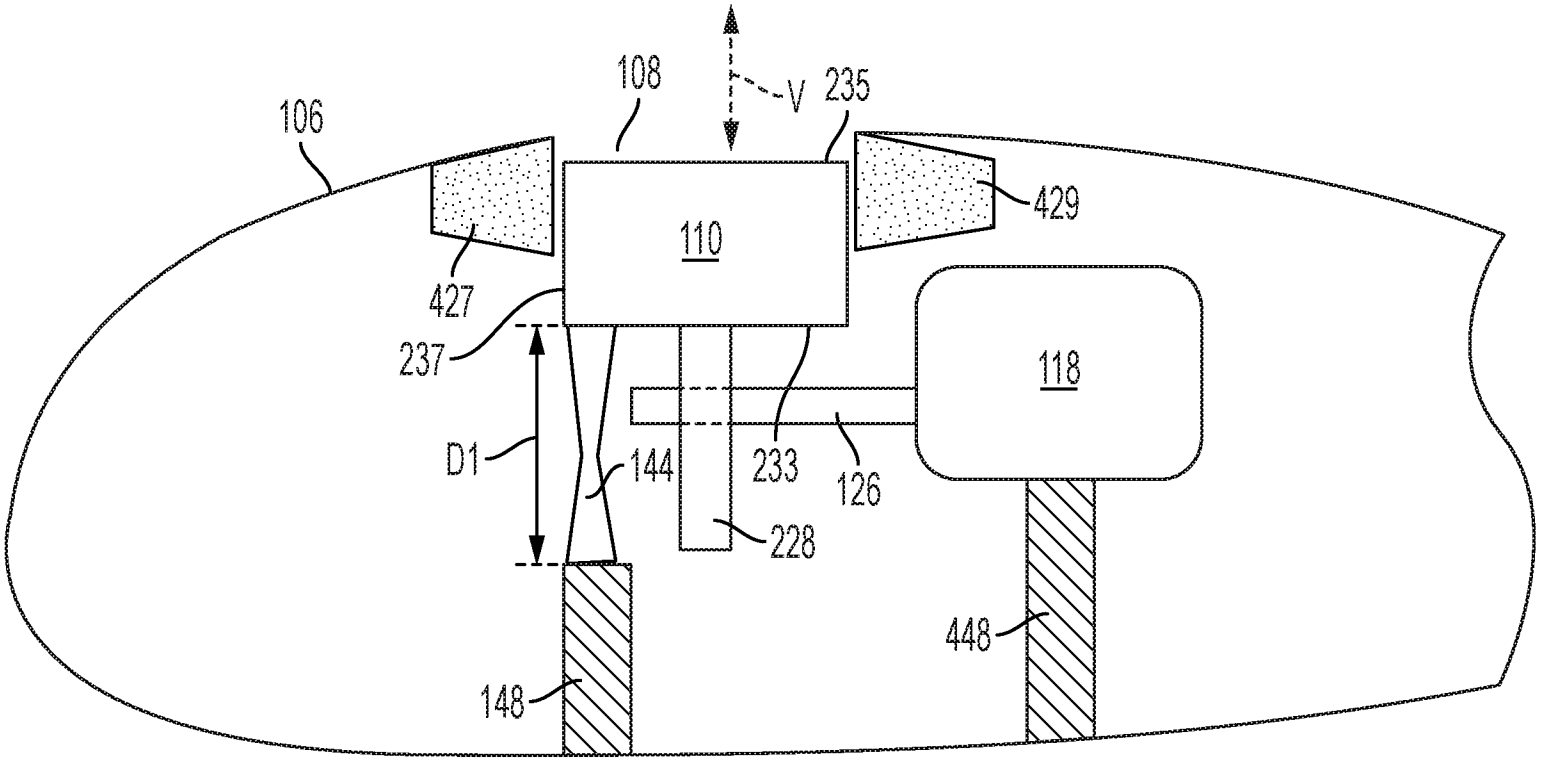
FIG. 4C shows a side view of a mechanical finger in accordance with additional disclosed embodiments in a lowered configuration.

FIG. 4A-4D show details of operation of a massager in accordance with additional embodiments. In these embodiments, instead of a coupler connecting the mechanical finger to the cam, the cam is in direct physical contact with the mechanical finger. FIG. 4A shows a front view of a mechanical finger in accordance with additional disclosed embodiments in a lowered configuration (the term "lowered" as used here, refers to a state in which the mechanical finger is below the external boundary 130 and completely inside the enclosure of the device, below the external boundary of the front enclosure). FIG. 4C shows a side view of a mechanical finger inside an enclosure 106 in accordance with additional disclosed embodiments in a lowered configuration. Referring now to FIG. 4A and FIG. 4C, a cam 228 is shown. In some embodiments, the cam is circular or substantially circular, or oval-shaped or substantially oval-shaped. In embodiments, the cam 228 may be mounted off-center to shaft 126. As shown in FIG. 4A, the cam peak 129, which is the part of the cam at the greatest distance from shaft 126, is shown at a bottom-dead-center (BDC) position with respect to the shaft 126. In the BDC position, the mechanical finger 110 is disposed below the external boundary 130 of front enclosure 106. It should be recognized that the shape of the mechanical finger shown in the figure is exemplary, and any suitable shape, which still achieves the functional purpose, is included within the scope of the invention.

In embodiments, elastic member 142 and elastic member 144 are affixed to the mechanical finger 110. Elastic member 142 is also affixed to post 146. Elastic member 144 is affixed to post 148. In the lowered configuration (FIG. 4A, FIG. 4C), the mechanical finger 110 is at a distance D1 from the post 148. In the raised configuration (FIG. 4B, FIG. 4D), the mechanical finger 110 is at a distance D2 from the post 148, where D2>D1. Post 146 and 148 may be affixed to an interior side of front enclosure 106 or other suitable anchor point. Elastic members 142 and 144 can include stretchable cords, rubber bands, metal springs, plastic springs, or other suitable elastic member that creates a force pulling the mechanical finger 110 towards the posts 146 and 148. Affixation of the elastic member may be achieved by rivets, indicated generally as 157. In other embodiments, screws, adhesives, friction fit couplings, or other suitable devices may be used instead of, or in addition to, rivets 157. In some embodiments, an external silicone membrane serves to keep the mechanical finger 110 in contact with the cam instead of, or in addition to, the elastic members 142 and 144. Note, in these embodiments the cam may not be permanently connected to the mechanical finger, but rather, pressed against the cam by the elastic members.

Referring specifically to FIG. 4C, it can be seen that the post 148 is affixed to the interior side of the front enclosure 106. Additionally, the motor mount 148 is also affixed to the interior side of the front enclosure 106 to secure the motor 118 in place. The mechanical finger has a first side 233 that is disposed facing an interior of the enclosure. The mechanical finger has a second side 235 that is disposed facing an interior of the enclosure, which interfaces with the drive unit. The mechanical finger 110 has a side surface, indicated generally as 237. As seen in FIG. 4C, embodiments may further include a front guide block 427 and a rear guide block 429. Front guide block 427 and rear guide block 429 are affixed to the interior side of the front enclosure 106 proximal to the opening 108 to serve as a guide for the mechanical finger 110 during operation to improve stability of the mechanical finger during operation by confining the mechanical finger 110 to motion in the direction indicated by arrow V.

Figure 4D:
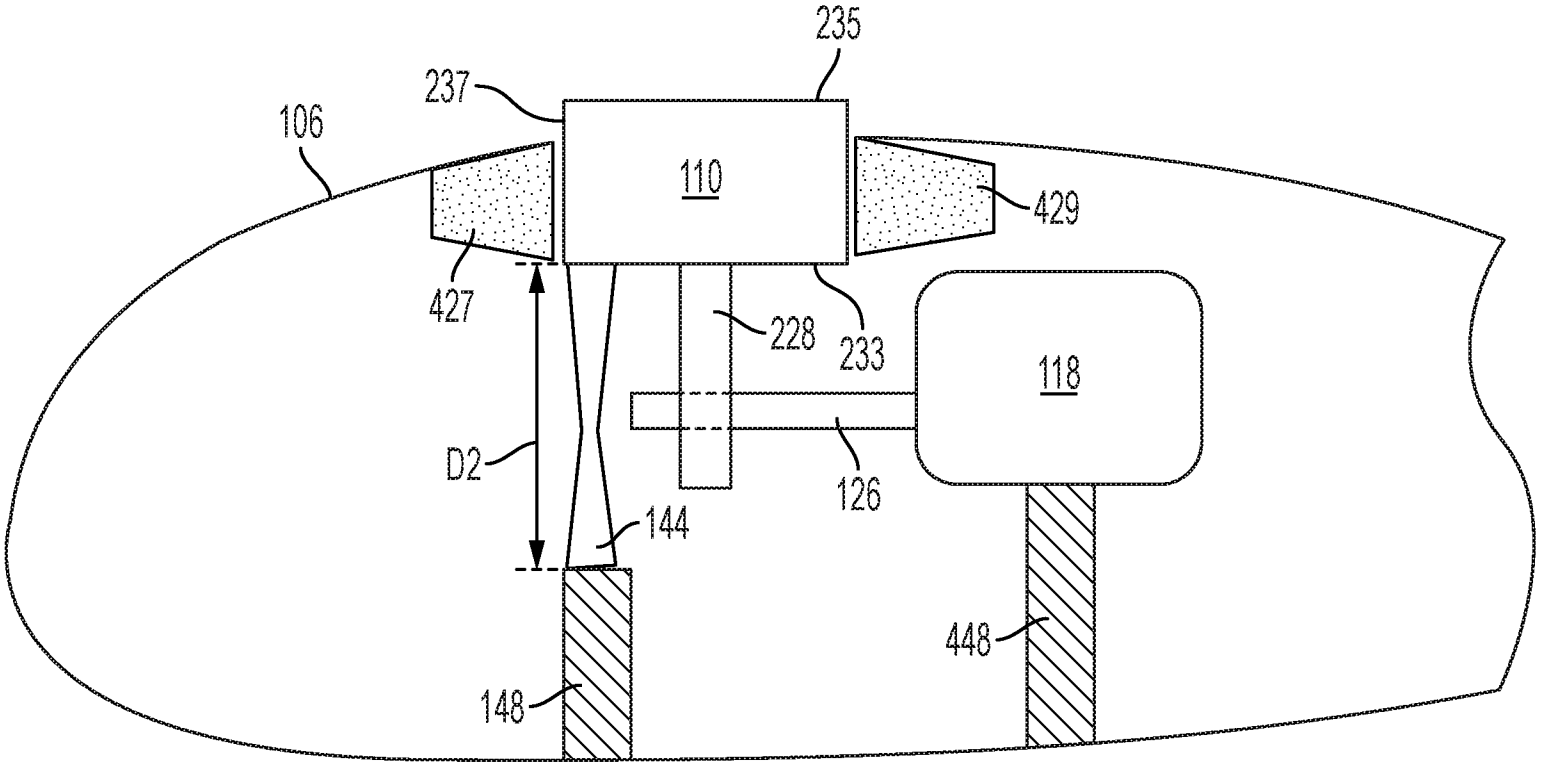
FIG. 4D shows a side view of a mechanical finger in accordance with additional disclosed embodiments in a raised configuration.

Referring now to FIG. 4B and FIG. 4D, due to rotation of the shaft 126 by motor 118, the cam peak 129 is now positioned at top-dead-center (TDC) with respect to the shaft 126. FIG. 4D shows a side view of a mechanical finger inside an enclosure 106 in accordance with additional disclosed embodiments in a raised configuration. In the TDC position, the mechanical finger 110 is disposed above the external boundary 130 of front enclosure 106, thereby imparting a force on a user when the device is pressed against the user (with the mechanical finger facing the user). Thus, in some embodiments, the cam has direct physical contact with the mechanical finger 110. As can be seen in FIGS. 4A and 4B, the cam 228 is oval-shaped. Other embodiments may utilize a different cam shape in order to create a different massage pattern, thus creating a variety of user experiences when using devices of disclosed embodiments. Note, for clarity, the membrane 102 is not shown in FIG. 4C and FIG. 4D.

Figure 5B:
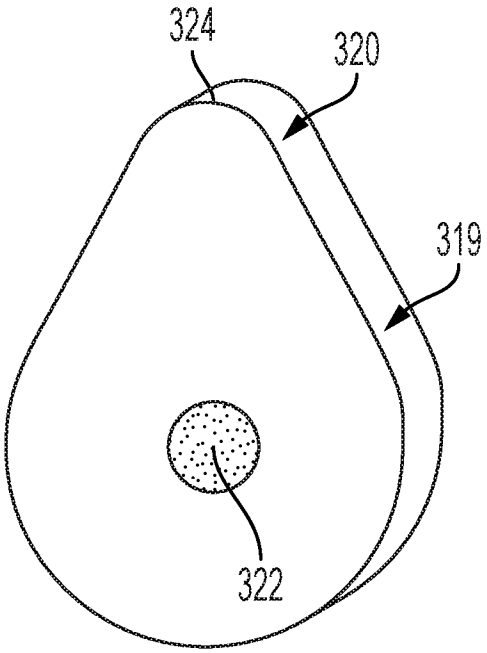
FIG. 5B shows a lobed symmetrical cam that may be used in some embodiments.
Figure 5A:
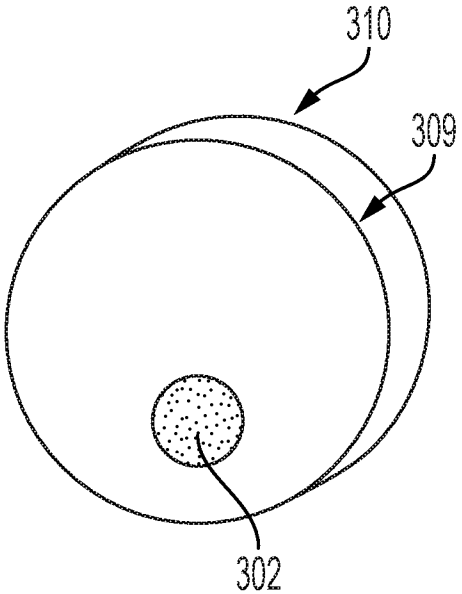
FIG. 5A shows a circular cam that may be used in some embodiments.
Figure 5D:
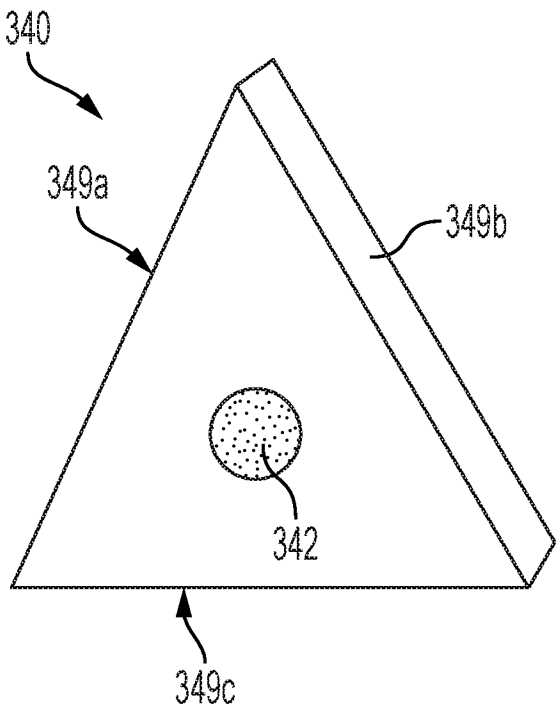
FIG. 5D shows a triangular cam that may be used in some embodiments.
Figure 5C:
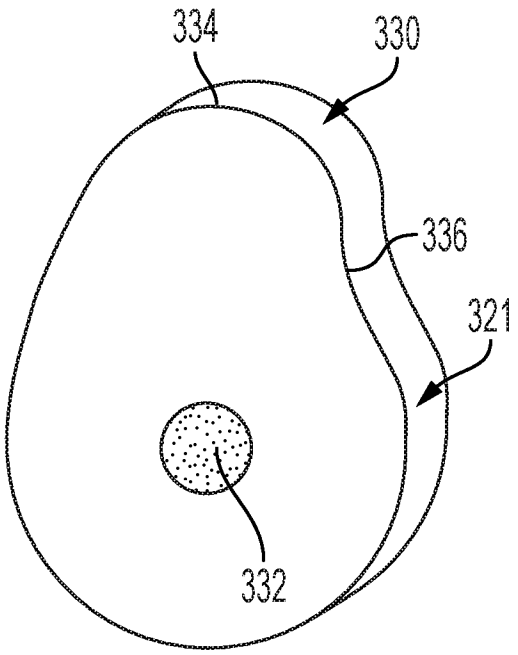
FIG. 5C shows a lobed asymmetrical cam that may be used in some embodiments.

FIGS. 5A-5F show examples of cams for embodiments of the present invention that utilize direct cam contact with the mechanical finger as shown in FIGS. 4A and 4B. Thus, instead of an oval shaped cam 228 as shown in FIGS. 4A and 4B, other types of cams may be used. That is, the cams shown in FIGS. 5A-5F may be used in place of the oval cam shown in FIGS. 4A-4B. In FIG. 5A, the cam 310 is an eccentrically mounted round cam. The center of rotation for the cam 310 is indicated as 302. The center of rotation is the location on the cam where the cam is mounted to the shaft of the motor. The lateral wall 309 of the cam 310 is circular. FIG. 5B shows a cam 320 that is a lobed symmetrical cam. Cam 320 has lobe 324, and center of rotation 322. Accordingly, its lateral wall 319 is lobular in shape. FIG. 5C shows a cam 330 that is a lobed asymmetrical cam. Cam 330 has lobe 334 and center of rotation 332. Cam 330 also has an indentation 336. Accordingly, its lateral wall 321 is irregular in shape.

Figure 5F:
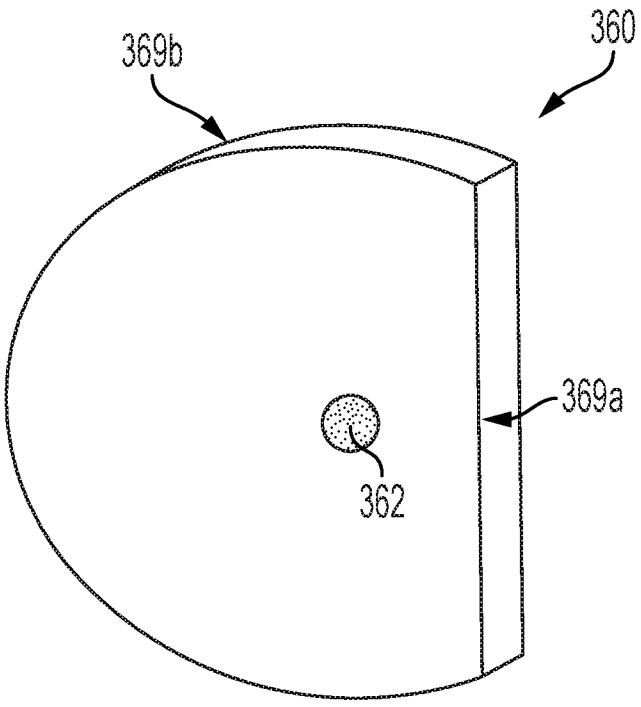
FIG. 5F shows a D-shaped cam that may be used in some embodiments.
Figure 5E:
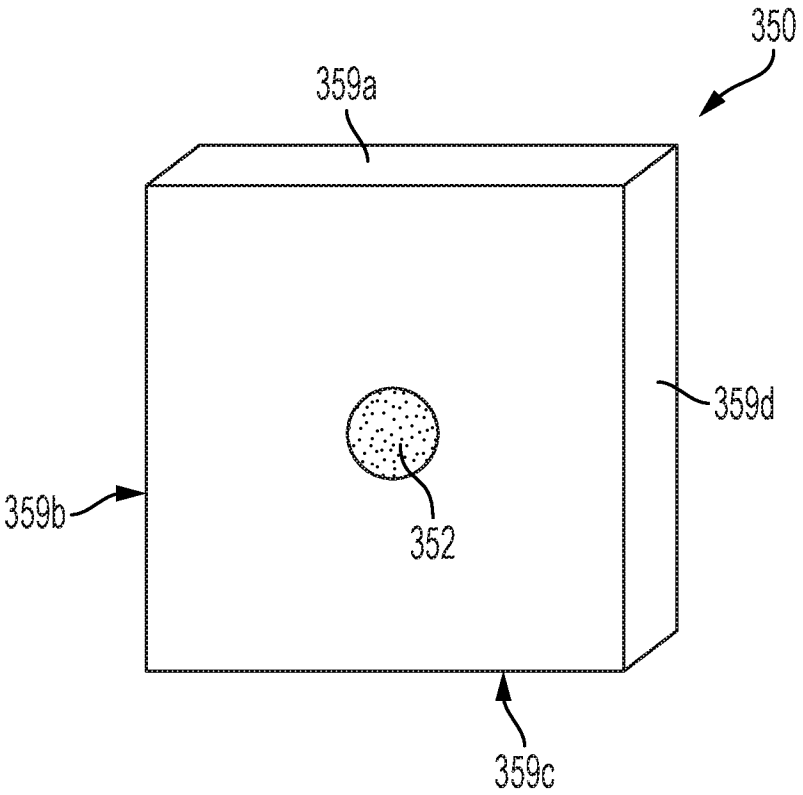
FIG. 5E shows a square cam that may be used in some embodiments.

In some embodiments, the cam is a polygon as shown in FIGS. 5D and 5E. FIG. 5D shows a cam 340 that is a triangular cam. Cam 340 has three straight lateral sides 349*a*, 349*b*, 349*c* that, in operation, contact and move the mechanical finger. The center of rotation for the cam is indicated as 342. FIG. 5E shows a cam 350 that is a square cam. Cam 350 has four straight lateral sides 359*a*, 359*b*, 359*c*, and 359*d* that, in operation, contact and move the mechanical finger. The center of rotation for the cam is indicated as 352.

FIG. 5F shows an additional cam in accordance with embodiments of the present invention. Cam 360 is a "D-shaped" cam having flat side lateral wall 369*a*, and rounded side 369*b*. The center of rotation for the cam is indicated as 362.

Figure 6A:
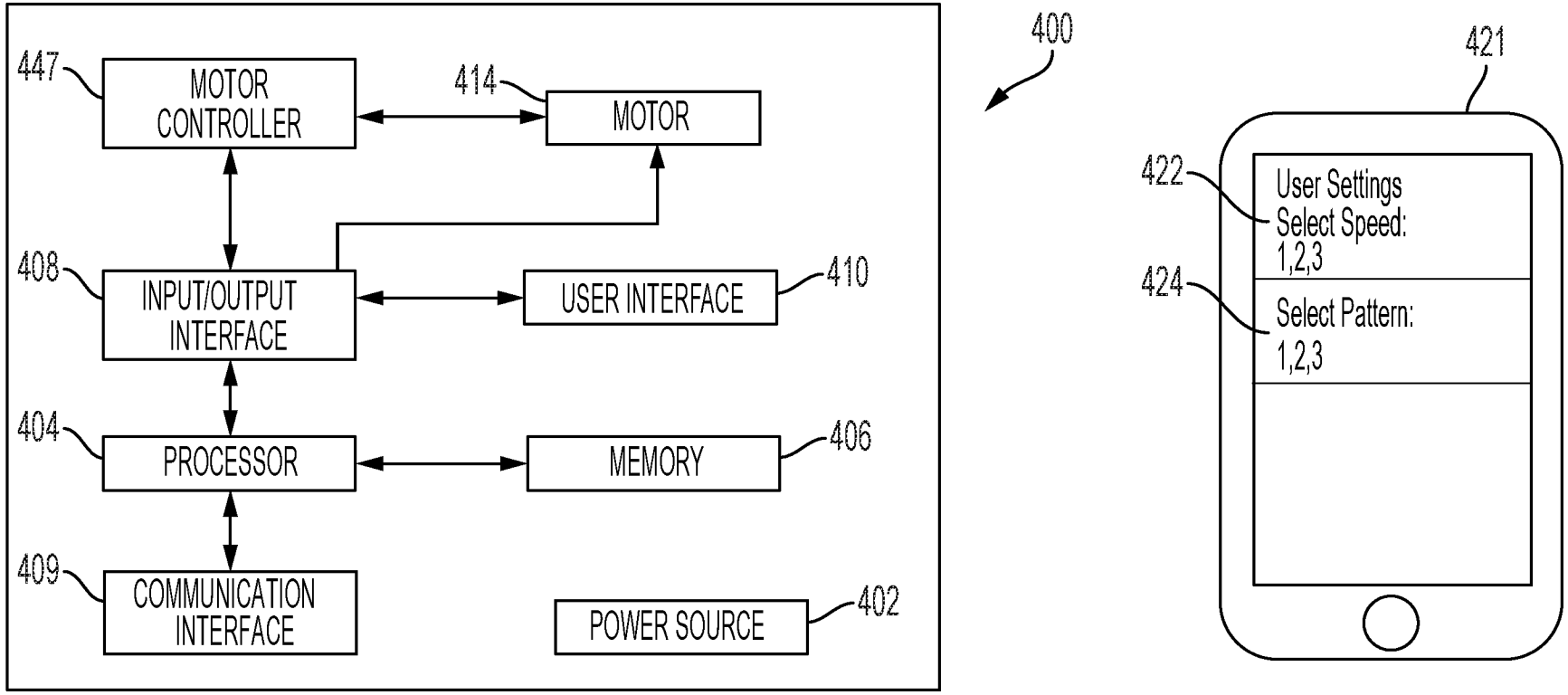
FIG. 6A is a block diagram showing components of disclosed embodiments.

FIG. 6A is a block diagram showing components of an embodiment of the present invention. Device 400 includes a processor 404 and a memory 406 coupled to the processor 404, an input/output (I/O) interface 408 coupled to the processor 404, and a user interface 410 coupled to the I/O interface 408.

A power source 402 powers the processor 404, motor 414, and other electronic components. Power source 402 may be a battery, which may be a replaceable, or internally sealed rechargeable battery. In some embodiments, the battery may be USB-chargeable, inductively chargeable, or other suitable charging mechanism now known or hereafter developed. It should be recognized that any power source, now known or hereafter developed, may be used. More than one battery may be included in some embodiments. In some embodiments, the stimulation device may be powered by alternating current power, such as 120V or 240V standard household power, with a power adapter comprising voltage regulators to convert the power to an appropriate DC level (e.g. 12V DC).

The memory 406 may include a non-transitory computer readable medium including, but not limited to, flash, EEPROM, static ram (SRAM), or other suitable storage type. The memory 406 contains instructions, that when executed by processor 404, enable embodiments of the present invention. The user interface 410 may comprise one or more buttons, lights, buzzers, liquid crystal displays, and/or other suitable components for control and operation of the device.

The massager further includes motor 414. The direction of movement of motor 414 may be controlled via a signal from input/output interface 408. In embodiments, motor controller 447 receives signals from the input/output interface 408. These signals can include signals indicative of desired operating speed, battery voltage level, and/or motor current draw. The motor controller 447 includes components to operate a closed loop feedback system for control of the motor 414, to provide a consistent user experience in terms of motor performance during various operating conditions. The operating conditions can include battery level/life remaining, and/or the induced load on the motor cause by the amount of force the user uses when pressing the device against his/her body. In embodiments, the motor controller 447 may communicate with the processor 404 through a communication bus, serial interface, or other suitable technique as is known in the art.

The device may further include a communication interface 409, which may support a wired and/or wireless communication protocol, including, but not limited to, Wi-Fi, Bluetooth, infrared, or other suitable communication protocol. Accordingly, in some embodiments, the user interface 410 may not be present.

The communication interface 409 can enable communication with a remote device 421 such as a smartphone or tablet computer to enable additional user interface functions on the remote device. In some embodiments, the massager 400 may be controllable via an application on the remote device 421, instead of, or in addition to user interface 410.

In some embodiments, a user interface rendered on remote device 421 may include additional options. In embodiments, the additional options include a speed setting 422. The speed setting may have various available levels (e.g., level 1, 2, and 3). Each level may correspond to a different operational speed of motor 414. In embodiments, the additional options include a frequency setting 424. The frequency setting may have various available levels (e.g., option 1, 2, and 3). Each level may correspond to a different frequency of a massage pattern created by motor 414. As a non-limiting example, a pattern according to option 1 can include 200 milliseconds of motor operation, followed by a pause for 300 milliseconds. Similarly, a pattern according to option 2 can include 400 milliseconds of motor operation, followed by a pause for 300 milliseconds. Similarly, a pattern according to option 3 can include 800 milliseconds of motor operation, followed by a pause for 500 milliseconds. These are exemplary patterns, and other patterns are possible with disclosed embodiments.

In some embodiments, the remote device 421 may provide a speech control function, in which a user can control the device 400. In these embodiments, a user may utter a control word such as "faster" or "slower." Upon detecting a control word, the remote device 421 may issue a command (e.g. via wireless communication protocol such as Bluetooth®) which is received by processor 404. Processor 404, in response to receiving the control word, alters the operational speed of the motor 414 accordingly. In this way, hands-free adjustment of the device is 400 is possible.

Figure 6B:
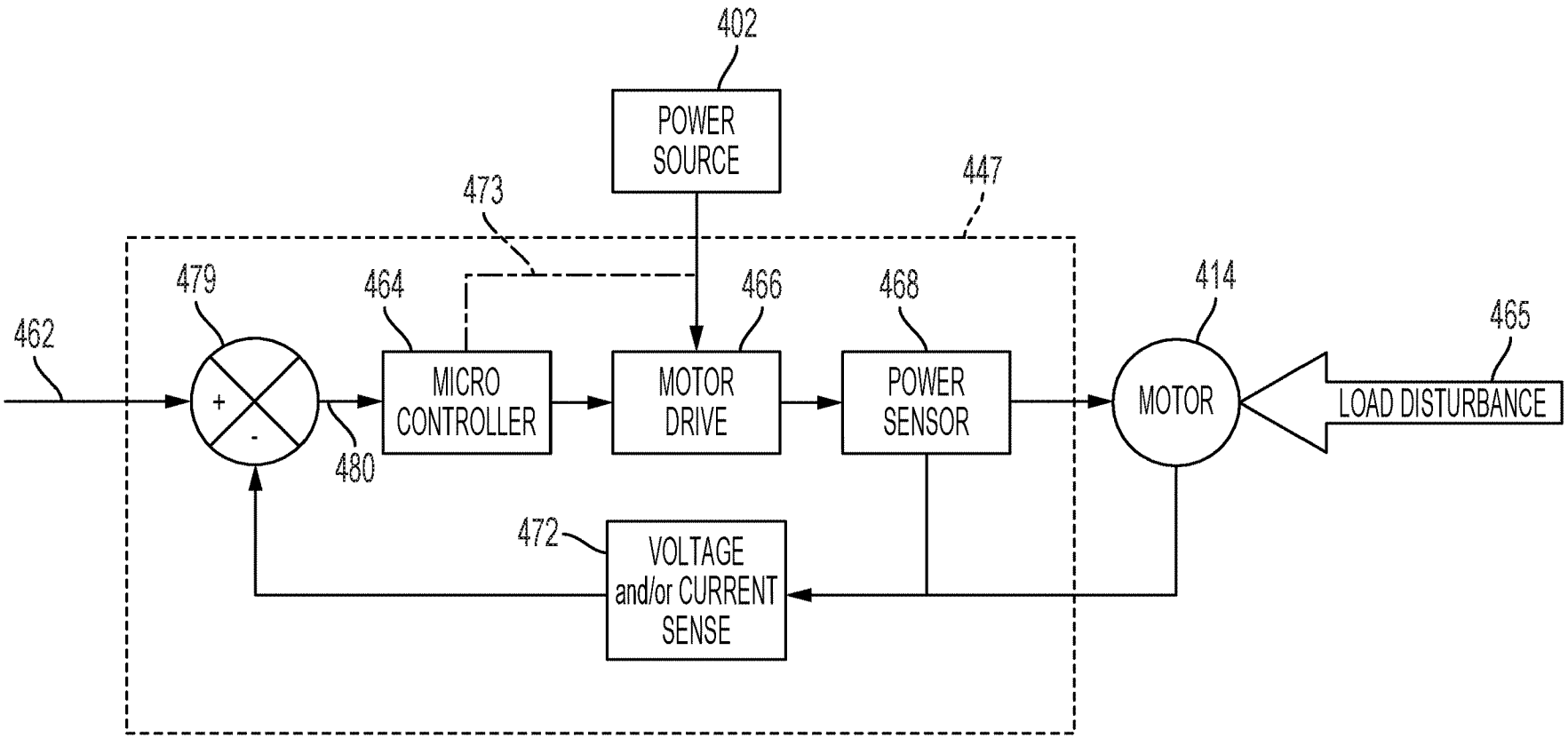

FIG. 6B shows details of a motor controller 447 in accordance with embodiments of the present invention. The motor controller 447 includes a microcontroller 464. The microcontroller 464 is coupled to a motor drive module 466 which contains additional circuitry for creating voltages suited to operation of motor 414. A power sensor 468 detects the amount of powering being drawn by the motor 414. A closed loop control is accomplished by having a feedback path from the motor to voltage and/or current sense module 472, to comparator 479. Comparator 479 also is configured to receive a user set point signal 462. The user set point signal 462 is indicative of a request speed of operation of the device. The microcontroller 464 receives a signal 480 based on the user set point signal and the voltage and/or current sense 472. Additionally, a signal 473 representative of the energy level of the power source 402, such as batteries, that power the motor 414 is also input to the microcontroller 464. The microcontroller 464 then performs computations to generate a corresponding output from the motor drive 466 to control the motor 414 at the desired speed. As the user presses a device against his/her skin, an increase in motor load (indicated by arrow 465) occurs. The motor controller 447 serves to maintain a consistent operational speed of motor 414 during use, taking in to account the changing conditions of battery life, and the pressure the user applies on the motor during use. This provides an enhanced user experience by maintaining a desired speed, and hence, provides the type of massage the user wants.

FIG. 7 shows an example usage of disclosed embodiments. As can be seen in FIG. 5, a user (pelvic region shown) 502 can place a massager 514 in accordance with disclosed embodiments against their clitoris 505 (indicated by the rectangle shape for the purposes of this disclosure). The massager 514 may be operated such that it is in direct physical contact with the clitoris 505 as illustrated in FIG. 6. Additionally, the massager 514 may be operated such that garments such as underwear and/or pants are disposed between the clitoris 505 and the massager 514. In embodiments, the device 514 is a handheld device, and may be held in place by the hand 519 of a user or partner. In some embodiments, the device 514 may be held in place by a belt or other supporting object, such that it can be operated in a hands-free mode. The massager may be used on other parts of the body, such as the face, arms, shoulders, etc.

FIG. 8 is a flowchart 600 showing an example operating mode of disclosed embodiments. At 650, the device operates in massage mode for a duration A. In embodiments, duration A can range from 10 seconds to 5 minutes or other times desired by the user. Massage mode is a low-speed mode of operation in which the sensation feels more like manipulation of fingers (i.e. tapping), as opposed to a vibration. Embodiments can operate at a first speed of the motor, such that the cam rotates with a frequency ranging from 1 Hertz to 8 Hertz, or 1 to 10 Hertz.

At 652, a delay interval of duration B is applied. In embodiments, the duration B may range from 100 to 300 milliseconds. Other suitable durations are possible within the scope of disclosed embodiments.

At 654, the device operates in vibrate mode for a duration C in a "boost" mode. In embodiments, duration C can range from 5 seconds to 30 second or any other duration desired by the user. Embodiments can operate at a second speed of the motor, such that the cam rotates with a frequency, for example, ranging from 15 Hertz to 50 Hertz. The second speed of the motor can be faster than the first speed of the motor. The first speed of the motor can correspond to a massage mode of the device. The second speed of the motor can correspond to a "vibrate" mode of the device since it feels to the user similar to a vibrator having a motor with an offset weight.

In some embodiments, the motor can pause indefinitely/stop after the duration of the boost mode.

In other embodiments, the motor can pause for a fourth duration after the rotating at the second speed. At 656, a delay interval of duration D is applied. In embodiments, the duration D may range from 100 to 300 milliseconds or other interval desired by the user. The process may then repeat for as long as the user wishes to use the device.

It should be recognized that in FIG. 8, there is shown an example operating mode. In some embodiments, the first mode is vibrate and the second mode is massage. In other embodiments, the operating mode includes only massage modes or only vibrate modes.

It should also be recognized that the device may be pre-programed for certain patterns formed by the intervals, or may be programmed or started by the user using a button, connected app, or other user interface. In other embodiments, the boost mode may be initiated by a sensor.

FIG. 9 shows a cross section view of a massager 900 in accordance with additional embodiments. Massager 900 is similar to massager 100 in some regards. However, massager 900 does not include the membrane 102 of FIG. 1A. Instead, massager 900 includes cover 902, which may be comprised of silicone, plastic, or other suitable material. Enclosure 906 (similar to enclosure 106) has an opening formed by edge 950 around the, and cover 902 extends from the enclosure 906 to the mechanical finger over the opening 950. The mechanical finger has a first side 933 that is disposed facing an interior of the enclosure. The mechanical finger has a second side 935 that is disposed facing an interior of the enclosure. The mechanical finger 910 has a side surface, indicated generally as 937. Drive unit is shown generally as box 919. In these embodiments, the cover 902 can seal partway up the mechanical finger 910 as shown at 917 where it contacts the side surface 915 of the mechanical finger 910, leaving a portion of the sidewall of mechanical finger 910, indicated as 927, exposed. There is no covering over the second side of the mechanical finger 910. Note that the seal of 917 extends around the entire side surfaces of the mechanical finger 910, such that a full seal of inside of the enclosure (formed by 106 and 104) is formed, protecting the internal components of the device from dust, moisture, and other contaminants. In some embodiments, the mechanical finger 910 is comprised of surgical stainless steel, another metal, polished stone, gemstone, glass, or other suitable material. The mechanical finger 910 comprised of one or more of the aforementioned materials has a higher durometer value than silicone. Some users may prefer the feeling of a harder material, and may thus find these embodiments enhance the user experience.

FIG. 10 shows a bottom-up view of the device having an example of a single button user interface 1013 thereon. In embodiments, a single button 1014 is used to control operation of the device. In embodiments, button 1014 serves as a speed control. In embodiments, button 1014 is a rocker style button, which can be pressed in region 1016 to cause a reduction in operational speed of the device, or pressed in region 1018 to cause an increase in operational speed of the device. It should be recognized that this is an example, and another suitable user interface can be substituted.

FIG. 11 shows a view indicating details of a mechanical finger in accordance with an additional embodiment. In this embodiment, there is a pad 1142 between the mechanical finger 1140 and the membrane 1144. that covers enclosure 1106. Membrane 1144 is a higher durometer than the pad 1142 disposed over the mechanical finger 1140, in order to more closely mimic the feel of a human finger. The pad 1142 may be affixed to the mechanical finger 1140 via adhesive or other suitable mechanism. In embodiments, the membrane 1144 has a durometer of Shore A20 to Shore A50, and the pad 1142 has a durometer value of 10 to 15 less than the membrane 1144. In embodiments, the pad 1142 may be comprised of silicone, rubber, plastic, or other suitable material. In embodiments, the membrane 1144 may be comprised of silicone, rubber, plastic, or other suitable material. The mechanical finger 1140 may be comprised of plastic, metal, glass, stone, or other suitable material.

The embodiment shown in FIG. 11 utilizes multiple materials of varying densities/hardness to emulate the feeling of a human appendage, such as a finger. A human finger comprises a rigid bone, and softer flesh is disposed around the bone. To emulate this, the mechanical finger 1140 may be comprised of a relatively rigid material such as metal, polycarbonate, or the like, and represents the "bone." The pad 1142 may be comprised of a polystyrene foam, rubber, or other suitable material, and represents the "flesh." During use, the pad 1142 compresses slightly as the mechanical finger pushes out past enclosure 1106 against the membrane 1144 toward the user during use of the device. The combination of the softer pad 1142 with the more rigid mechanical finger 1140 supporting it, can provide a pleasurable sensation for some users. Although this figure is shown with coupler 1134 for a drive unit like that of FIGS. 2A and 2B, another drive unit could be substituted, for example, that of FIGS. 4A and 4B.

As can now be appreciated a device in accordance with disclosed embodiments can provide a combination of sensations that include a sensation of a vibrator, as well as a sensation of manual manipulation by human fingers or tongue, generating a unique and pleasurable sensation for the user.

While the invention has been particularly shown and described in conjunction with exemplary embodiments, it will be appreciated that variations and modifications will occur to those skilled in the art. The embodiments according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A massager, comprising:
an enclosure having an opening therein;
a motor disposed within the enclosure;
a shaft coupled to the motor;
a mechanical finger mechanically coupled to the motor, wherein the mechanical finger is configured to periodically protrude from the opening of the enclosure;
a cam disposed on a distal end of the shaft;
a coupler coupled to the cam and the mechanical finger;
a plurality of elastic members mechanically coupled to the mechanical finger and the enclosure; and
a membrane disposed over at least a portion of the enclosure and covering the mechanical finger.

2. The massager of claim 1, wherein a pad is disposed between the mechanical finger and the membrane.

3. The massager of claim 2, wherein the mechanical finger is rigid, and the pad has durometer of 10 to 15 less than the membrane.

4. A massager comprising:
an enclosure having an opening therein;
a motor disposed within the enclosure;
a mechanical finger configured to periodically protrude from the opening of the enclosure; and
a membrane disposed over at least a portion of the enclosure and covering the mechanical finger,
wherein the mechanical finger is configured and disposed to contact a cam, wherein the cam is not permanently attached to the mechanical finger.

5. The massager of claim 4, wherein the cam is oval-shaped.

6. A massager comprising:
an enclosure having an opening therein;
a motor disposed within the enclosure;
a mechanical finger mechanically coupled to the motor, aligned with the opening;
a plurality of elastic members mechanically coupled to the mechanical finger and the enclosure;
a cam mechanically coupled to the motor;
a membrane disposed over at least a portion of the enclosure and covering the mechanical finger;
a processor; and
a memory, wherein the memory contains instructions, that when executed by the processor, cause the mechanical finger to periodically protrude from the opening of the enclosure; and
perform an operation sequence, wherein the operation sequence comprises the motor operating at a first speed for a first duration, followed by operating for a second speed for a second duration.

7. The massager of claim 6, wherein the memory further contains instructions, that when executed by the processor, cause the motor to pause for a third duration after the operating at the first speed and before the operating at the second speed.

8. The massager of claim 7, wherein the memory further contains instructions, that when executed by the processor, cause the motor to pause for a fourth duration after the operating at the second speed.

9. The massager of claim 6, wherein the memory further contains instructions, that when executed by the processor, cause the first speed of the motor to operate such that the cam rotates with a frequency ranging from 1 Hertz to 10 Hertz.

10. The massager of claim 9, wherein the memory further contains instructions, that when executed by the processor, cause the second speed of the motor to operate such that the cam rotates with a frequency ranging from 15 Hz to 50 Hz.

11. The massager of claim 8, wherein the memory further contains instructions, that when executed by the processor:

cause the first speed of the motor to operate such that the cam rotates with a frequency ranging from 2 Hertz to 8 Hertz;

cause the second speed of the motor to operate such that the cam rotates with a frequency ranging from 15 Hz to 50 Hz; and cause the third duration to range from 100 milliseconds to 300 milliseconds.

12. The massager of claim 11, wherein the memory further contains instructions, that when executed by the processor, cause the fourth duration to range from 100 milliseconds to 300 milliseconds.

13. The massager of claim 6, wherein the membrane is comprised of silicone.

14. The massager of claim 6, wherein the cam is triangular.

15. The massager of claim 6, wherein the mechanical finger is configured and disposed to contact the cam.

* * * * *